US010311776B2

(12) United States Patent
Park

(10) Patent No.: US 10,311,776 B2
(45) Date of Patent: Jun. 4, 2019

(54) DISPLAY DEVICE AND METHOD OF COMPENSATING FOR COLOR DEFLECTION THEREOF

(71) Applicant: Samsung Display Co., Ltd., Yongin-si, Gyeonggi-do, OT (KR)

(72) Inventor: Hye Sang Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 49 days.

(21) Appl. No.: 15/233,833

(22) Filed: Aug. 10, 2016

(65) Prior Publication Data

US 2017/0169758 A1 Jun. 15, 2017

(30) Foreign Application Priority Data

Dec. 11, 2015 (KR) ..... 10-2015-0176642

(51) Int. Cl.

| | |
|---|---|
| ***G09G 3/36*** | (2006.01) |
| ***G09G 3/20*** | (2006.01) |
| ***G09G 3/3208*** | (2016.01) |
| ***G09G 5/02*** | (2006.01) |

(52) U.S. Cl.

CPC ..... *G09G 3/2096* (2013.01); *G09G 3/2003* (2013.01); *G09G 3/3208* (2013.01); *G09G 5/02* (2013.01); *G09G 2320/0242* (2013.01)

(58) Field of Classification Search

USPC ..... 345/99–100

See application file for complete search history.

(56) References Cited

U.S. PATENT DOCUMENTS

| | | | | |
|---|---|---|---|---|
| 6,348,931 | B1 * | 2/2002 | Suga | G09G 5/006 345/3.3 |
| 8,106,930 | B2 | 1/2012 | Wang et al. | |
| 8,670,006 | B2 | 3/2014 | Hong et al. | |
| 2009/0135211 | A1 | 5/2009 | Wang et al. | |
| 2014/0160142 | A1 * | 6/2014 | Lee | G09G 3/3208 345/589 |
| 2015/0116387 | A1 | 4/2015 | Jun et al. | |

FOREIGN PATENT DOCUMENTS

| | | | |
|---|---|---|---|
| KR | 10-1351414 | B1 | 1/2014 |
| KR | 10-2014-0054719 | A | 5/2014 |
| KR | 10-2015-0048394 | A | 5/2015 |

* cited by examiner

*Primary Examiner* — Roy P Rabindranath

(74) *Attorney, Agent, or Firm* — Lewis Roca Rothgerber Christie LLP

(57) ABSTRACT

A method of compensating for color deflection of a display device includes dividing a display region of a display panel into a plurality of partial regions, displaying a reference image in the display region, measuring optical characteristics of the partial regions based on the reference image, calculating a region compensation factor by the partial regions based on the optical characteristics, and storing the region compensation factor in a storage device.

14 Claims, 7 Drawing Sheets

DISPLAY DEVICE AND METHOD OF COMPENSATING FOR COLOR DEFLECTION THEREOF

CROSS-REFERENCE TO RELATED APPLICATION

This application claims priority to, and the benefit of, Korean Patent Application No. 10-2015-0176642, filed on Dec. 11, 2015, in the Korean Intellectual Property Office, the entire contents of which are incorporated herein by reference in their entirety.

BACKGROUND

1. Field

An embodiment of the present invention relates to a display device, and a method of compensating for color deflection thereof.

2. Description of the Related Art

A display device includes a display panel including a plurality of pixels, produces various driving voltages required for driving the display panel, and includes a driving circuit unit for generating control signals.

Recently, monitors or television displays have reduced weight and thickness. To meet demand, cathode ray tubes (CRTs) have been replaced with liquid crystal displays (LCDs). However, LCDs use a separate backlight as a light emitting element, and have many problems in terms of response speed and viewing angle.

Organic light emitting display devices have been highlighted as display devices that may overcome problems of LCDs. An organic light emitting display device includes two electrodes, and an emission layer positioned between the two electrodes, such that electrons injected from one electrode and holes injected from another electrode are combined in the emission layer to form excitons, and the excitons release energy to emit light.

Because the organic light emitting display device is self-emissive, and therefore does not require a separate light source, the organic light emitting display device has reduced power consumption. The organic light emitting display device also has excellent response speed, viewing angle, and contrast ratio. Here, the emission layer is formed of an organic material for emitting light of any one of primary colors, such as red, green, and blue colors, and displays a desired image by the spatial sum of the primary color emitted by the emission layer.

Meanwhile, due to incomplete characteristics of a transistor (TFT) and an organic light emitting diode (OLED) forming the organic light emitting display device, color deflection may occur in an image output through a panel. For example, even when image data having the same color and brightness is output on every pixel formed in the panel, irregular color deflection may occur in an image output through the panel.

SUMMARY

An embodiment of the present invention relates to a method of compensating for color deflection of a display device capable of compensating for color deflection of pixels of a display panel without a large capacity external memory.

Another embodiment of the present invention relates to a display device capable of compensating for color deflection of pixels of a display panel without a large capacity external memory.

A method of compensating for color deflection of a display device according to an embodiment of the present invention includes dividing a display region of a display panel into a plurality of partial regions, displaying a reference image in the display region, measuring optical characteristics of the partial regions based on the reference image, calculating a region compensation factor by the partial regions based on the optical characteristics, and storing the region compensation factor in a storage device.

The displaying of the reference image may include displaying a red image, a green image, or a blue image.

The region compensation factor may include a red region compensation factor for compensating a red color, a green region compensation factor for compensating a green color, and a blue region compensation factor for compensating a blue color.

The measuring of the optical characteristics may include capturing the reference image using a camera.

A resolution of the camera may be lower than a resolution of the display panel.

The measuring of the optical characteristics may include capturing the reference image using a color sensor array.

Each of the partial regions may include a plurality of pixels, and the optical characteristics may include an average brightness displayed in each of the partial regions.

The calculating of the region compensation factor may include calculating the region compensation factor corresponding to the partial regions based on the average brightness measured in the partial regions.

The storing of the region compensation factor may include storing the region compensation factor in a register within the display device.

A method of compensating for color deflection of a display device according to an embodiment of the present invention includes loading a region compensation factor corresponding to a plurality of partial regions of a display panel, processing the loaded region compensation factor to calculate a pixel compensation factor corresponding to each pixel of the display panel, receiving image data including pixel data, and compensating for a grayscale of each pixel data based on the pixel compensation factor.

The method may further include displaying the image data based on the compensated grayscale of each pixel data.

The loading of the region compensation factor may include loading the region compensation factor from an MTP register of the display device.

The processing of the loaded region compensation factor to calculate the pixel compensation factor may include calculating the pixel compensation factor by interpolating the region compensation factor according to resolution of the display panel.

The compensating for the grayscale of each pixel data may include compensating the grayscale of the pixel data based on the pixel compensation factor and a compensation rate by grayscales.

A display device according to another embodiment of the present invention includes a display panel including a plurality of partial regions, and an image data compensator for compensating for a grayscale of a plurality of pixel data of input image data based on a region compensation factor corresponding to the partial regions, and for outputting the compensated image data to the display panel.

The image data compensator may include a compensation factor storage device for storing the region compensation factor, a compensation factor converter for loading the region compensation factor, and for interpolating the region compensation factor according to a resolution of the display panel to calculate a pixel compensation factor, and a data converter for compensating for a grayscale of the pixel data based on the pixel compensation factor.

The image data compensator may further include a grayscale compensation rate determiner configured to calculate a compensation rate regarding each grayscale of pixel data, and the data converter may be for compensating for the grayscale of the pixel data based on the compensation factor regarding each grayscale and the pixel compensation factor.

The compensation factor storage device may include an MTP register.

In the display device and the method of driving the same according to the embodiment of the present invention, a kind of an image is determined by using image data, and a distribution voltage having a value corresponding to the determined kind of the image is supplied to a display panel.

In an embodiment of the present invention, a method of compensating for color deflection of a display device capable of compensating for color deflection of pixels of a display panel without a large capacity external memory may be provided.

In another embodiment of the present invention, a display device capable of compensating for color deflection of pixels of a display panel without a large capacity external memory may be provided.

BRIEF DESCRIPTION OF THE DRAWINGS

The above and other aspects of the present invention will be more clearly understood from the following detailed description when taken in conjunction with the accompanying drawings, in which.

DETAILED DESCRIPTION

Figure 1:
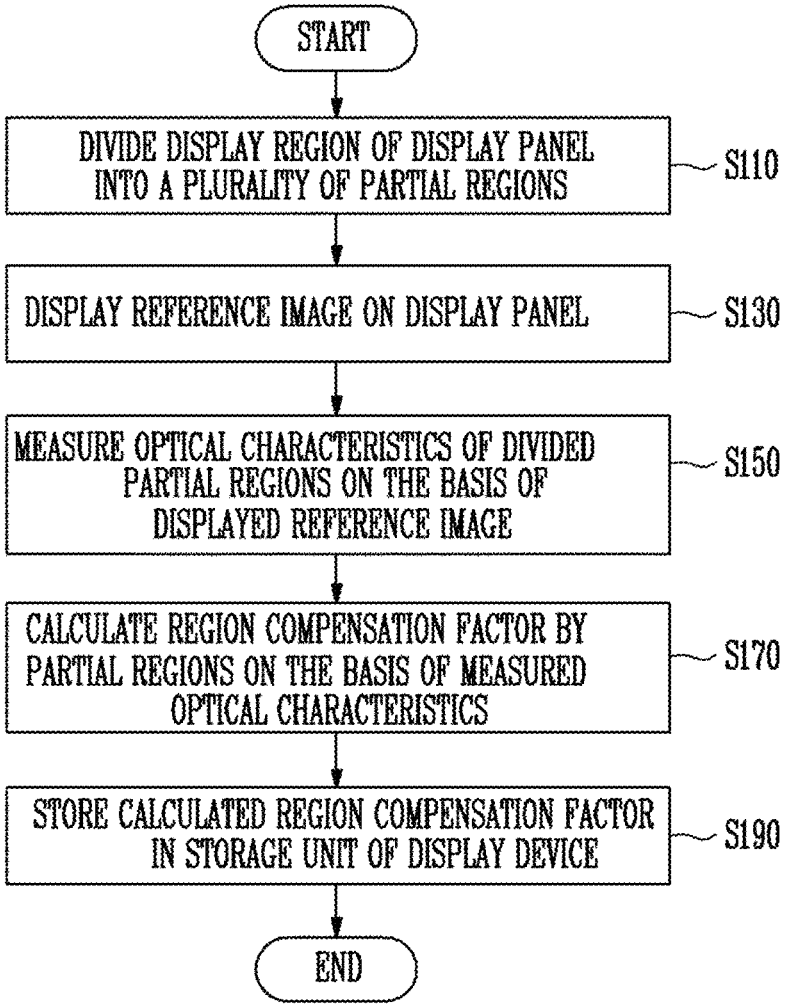
FIG. 1 is a flow chart illustrating a method of compensating for color deflection of a display device according to an embodiment of the present invention.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including,"

when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
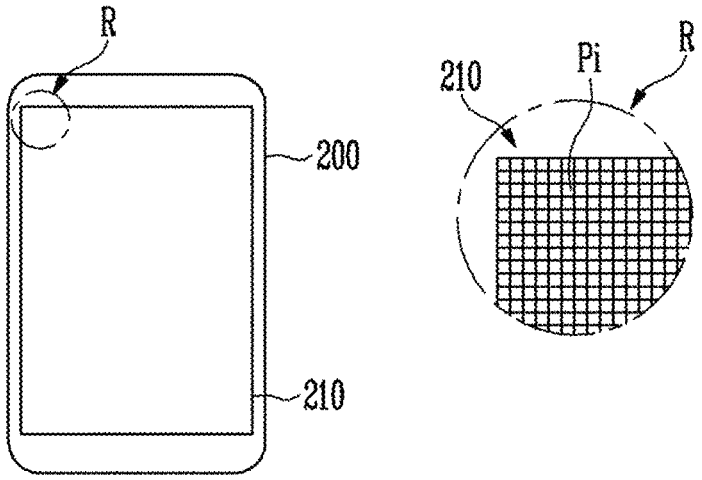
FIG. 2 is a view illustrating a process of calculating a compensation factor by pixels in a general color deflection compensation method.
Figure 3:
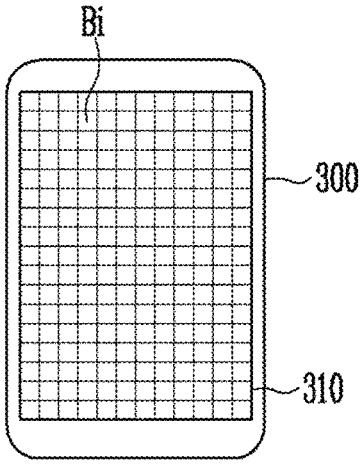
FIG. 3 is a view illustrating a process of calculating a region compensation factor by partial regions according to an embodiment of the present invention.

FIG. 1 is a flow chart illustrating a method of compensating for color deflection/compensating color deflection of a display device according to an embodiment of the present invention, FIG. 2 is a view illustrating a process of calculating a compensation factor by pixels in a general color deflection compensation method, and FIG. 3 is a view illustrating a process of calculating a region compensation factor by partial regions according to an embodiment of the present invention. Hereinafter, the method of compensating for color deflection of a display device according to an embodiment of the present invention will be described with reference to FIGS. 1 to 3.

Referring to FIG. 1, the method of compensating for color deflection of a display device according to an embodiment of the present invention includes operation (S110) of dividing a display region of a display panel into a plurality of partial regions, operation (S130) of displaying a reference image on the display panel, operation (S150) of measuring optical characteristics of the divided partial regions on the basis of the displayed reference image, operation (S170) of calculating a region compensation factor by partial regions on the basis of the measured optical characteristics, and operation (S190) of storing the calculated region compensation factor in a storage unit (e.g., storage, storage device, memory, or buffer) of the display device.

Referring to FIG. 2, there is depicted a display device 200, and a display panel 210 included in the display device 200. A partial region R of the display panel 210 is enlarged to be illustrated. As illustrated in the enlarged portion of the region R, the display panel 210 includes a plurality of pixels Pi. In a general color deflection compensation method, a reference image is displayed on the display panel 210, and an image expressed by the pixels Pi of the display panel 210 is analyzed to measure optical characteristics of each of the pixels Pi. That is, according to a difference in characteristics of a transistor and a light emitting element forming each of respective pixels Pi, there may be a difference in brightness and color appearing in different ones of the pixels Pi in spite of the same pixel data.

According to a conventional color deflection compensation method, a reference image is displayed through the display panel 210 of the display device 200, and optical characteristics expressed by each of the pixels Pi of the display panel 210 are photographed. In this case, the reference image may include a red image, a green image, and a blue image. Thereafter, the display panel 210 may be captured, or photographed, through image-capturing equipment, such as a high-definition camera. To specify optical characteristics of each of the pixels Pi of the display panel 210, resolution of the image-capturing equipment may be the same as, or greater than, resolution of the display panel 210. A compensation factor regarding each of the pixels Pi of the display panel 210 may be calculated through an image photographed by the image-capturing equipment. The compensation factor may include a compensation factor regarding at least two subpixels in every pixel.

For example, when each pixel Pi includes three subpixels (e.g., a red subpixel, a green subpixel, and a blue subpixel), when a red reference image is displayed, the display panel 210 may be photographed through the image-capturing equipment, and a compensation factor regarding a red color may be calculated for each pixel Pi. Also, when a green reference image is displayed, the display panel 210 may be photographed through the image-capturing equipment, and a compensation factor regarding a green color may be calculated for each pixel Pi. Also, when a blue reference image is displayed, the display panel 210 may be photographed through the image-capturing equipment, and a compensation factor regarding a blue color may be calculated for each pixel Pi. In this manner, three R, G, and B compensation factors may be calculated for each pixel PI. However, this is only an example, and a compensation factor corresponding to each pixel Pi may be determined in other ways according to a configuration of a subpixel included in each pixel Pi.

According to the above described conventional color deflection compensation method, a compensation factor is generated for each pixel Pi, and when the display device 200 is driven, the compensation factor is loaded. Thus, to store the compensation factor, a large capacity external memory is required. In addition, recently, as display devices have increased in size, and as resolution thereof has increased, a relatively large capacity memory is suitable for storing a compensation factor calculated through optical characteristics measurements. Meanwhile, to measure optical characteristics for each pixel Pi, high-definition image-capturing equipment is used, and an amount of time for setting up the equipment to capture a reference image is also increased.

According to a method of compensating for color deflection of a display device of an embodiment of the present invention, a display region of the display panel is divided into a plurality of partial regions, and a region compensation factor corresponding to a respective one of the partial regions is calculated through measurement of optical characteristics regarding the corresponding partial region. The partial region is divided to include a plurality of pixels. Thus, the number of partial regions is smaller than the number of the pixels. Thus, a corresponding region compensation factor may be stored in a relatively low capacity memory. Hereinafter, a method of compensating for color deflection of a display device according to an embodiment of the present invention will be described with reference to FIGS. 1 and 3.

Referring to FIG. 3, a display device 300 and a display panel 310 included in the display device 310 are illustrated.

In the operation (S110) of dividing a display region of the display panel into a plurality of partial regions, it is determined how many partial regions the display region of the display panel 310 is to be divided into. In the embodiment illustrated in FIG. 3, twelve partial regions across, and seventeen partial regions down, corresponds to a total of two hundred four partial regions Bi.

In the operation (S130) of displaying a reference image on the display panel, reference image data (e.g., predetermined reference image data) is displayed on the display panel 310. For example, the reference image data may represent a red image. Alternatively, the reference image data may represent a blue image or a green image. The reference image data is pixel data representing the same color and brightness. That is, the reference image data may be image data representing a uniform screen (i.e., a uniformly colored and uniformly lit screen).

In the operation (S150) of measuring optical characteristics regarding the divided partial regions Bi on the basis of the displayed reference image, the display panel 310 may be photographed using external image-capturing equipment that is separate from the display device 300. An image obtained through the image-capturing equipment may measure optical characteristics of each of the divided partial regions Bi of the display panel 310. As described above, the reference image data corresponds to an image representing a uniform screen. However, because optical characteristics of the pixels of the display panel 310 are different, partial images displayed in each of the regions Bi may be different from each other. For example, a partial image displayed in a first partial region may be slightly darker than a partial image displayed in a second partial region.

In the operation (S170) of calculating a region compensation factor by partial regions on the basis of the measured optical characteristics, a compensation factor regarding each of the partial regions Bi may be calculated on the basis of the measured optical characteristics. For example, in the operation (S170), a region compensation factor may be calculated on the basis of an average brightness appearing in each of the partial regions Bi.

In the operation (S150), optical characteristics regarding a displayed image may be measured using various image-capturing devices. For example, optical characteristics may be measured using a camera, or using a color sensor array. Unlike the conventional color deflection compensating method, in which high-definition image-capturing equipment is used, in the method of compensating for color deflection according to the present embodiment, because a region compensation factor regarding a partial region is calculated, optical characteristics regarding a displayed image may be measured using relatively low definition image-capturing equipment.

In the operation (S190) of storing a calculated region compensation factor in a storage unit of the display device, the calculated region compensation factor is stored. The storage unit may be a multiple time programmable (MTP) register having relatively low capacity. The number of generated region compensation factors may be the same as the number of the divided partial regions Bi of the display panel 310.

Conversely, according to the conventional color deflection compensating method described above with reference to FIG. 2, the number of compensation factors may be the same as the number of pixels Pi of the display panel 210. According to the conventional method, because the number of pixels Pi or the number of compensation factors corresponding thereto is used, a large capacity external memory is used to store the compensation factors. As a result, manufacturing cost of the display device is increased. Also, because a large number of compensation factors may be loaded when the display device is driven, an amount of time for preparing driving may be relatively long.

In contrast, according to the method of compensating for color deflection of a display device according to the present embodiment, because a reduced number of compensation factors is used, color deflection of a display device may be compensated using a low capacity memory. Also, according to the present embodiment, because optical characteristics of a partial region Bi including several pixels are measured, as opposed to measuring optical characteristics of the individual pixels, a relatively low definition image-capturing device may be used.

Operation S130 to operation S190 may be repeatedly performed on one or more colors. For example, operation S130 to operation S190 may be repeatedly performed on a red reference image to thereby calculate red region compensation factors, and to store the calculated red region compensation factors in the storage unit. Thereafter, for example, operation S130 to operation S190 may be repeatedly performed on a green reference image to thereby calculate green region compensation factors, and to store the calculated green region compensation factors in the storage unit. Finally, operation S130 to operation S190 may be repeatedly performed on a blue reference image to thereby calculate blue region compensation factors, and to store the calculated blue region compensation factors in the storage unit. Through the aforementioned process, the red, green, and blue partial region factors may be calculated for the plurality of partial regions Bi of the display panel 310, and the calculated red, green, and blue partial region factors may be stored in the storage unit of the display device 300.

Through the method described above with reference to FIGS. 1 through 3, region compensation factors regarding the partial regions Bi of the display device 300 are calculated. Meanwhile, a method of displaying image data on the display panel 310 of the display device 300 using the calculated region compensation factors will be described with reference to FIG. 4.

Figure 4:
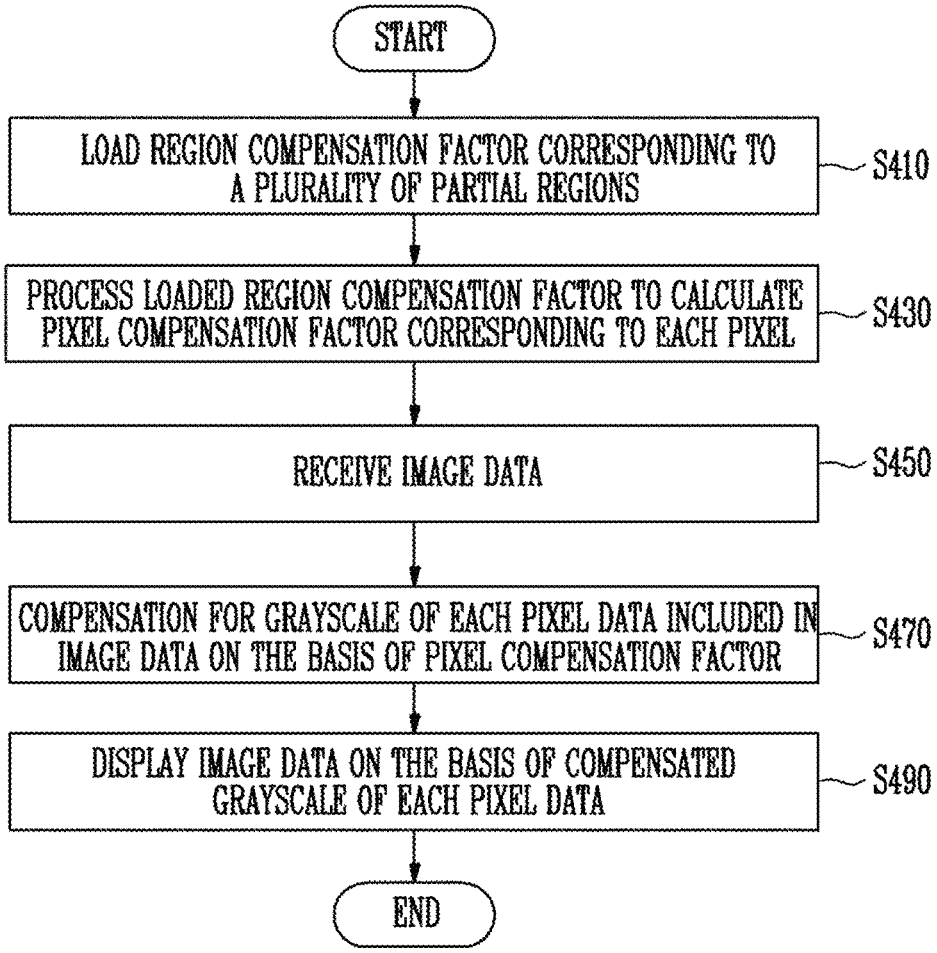
FIG. 4 is another flow chart illustrating a method of compensating for color deflection of a display device according to an embodiment of the present invention.
Figure 5:
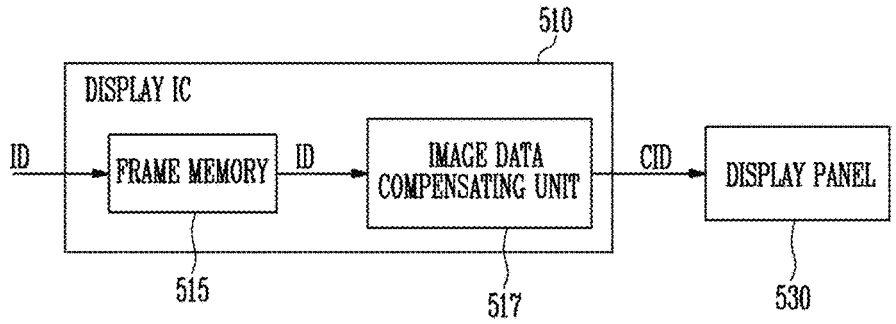
FIG. 5 is a block diagram illustrating a display device according to an embodiment of the present invention.

FIG. 4 is another flow chart illustrating a method of compensating for color deflection of a display device according to an embodiment of the present invention. Compensation factors of the display device are calculated according to the method illustrated in FIG. 1, and image data is displayed on the display panel of the display device according to the method illustrated in FIG. 4. FIG. 5 is a block diagram illustrating a display device according to an embodiment of the present invention.

First, referring to FIG. 5, the display device according to an embodiment of the present invention includes a display IC 510 and a display panel 530. The display IC 510 includes a frame memory 515 and an image data compensation unit (e.g., image data compensator) 517. The frame memory 515 stores image data ID provided in units of frames, and transfers the stored image data ID to the image data compensation unit 517. The image data compensation unit 517 converts the image data ID on the basis of a region compensation factor to generate converted image data CID. The converted image data CID is transferred to the display panel 530.

Although FIG. 5 illustrates that the image data compensation unit 517 is included in the display IC 510, some of components of the image data compensation unit 517 may be implemented outside of the display IC 510 in other embodiments.

According to an embodiment, at least some of the components of the image data compensation unit 517 may be implemented in an external device, such as an application processor.

A person skilled in the art will understood that at least some of the components of the image data compensation unit 517 may be implemented in the form of a product including a computer-readable program code stored in a computer-readable medium. The computer-readable program code may be provided as an application processor, or as a processor of any other data processing device.

Figure 6:
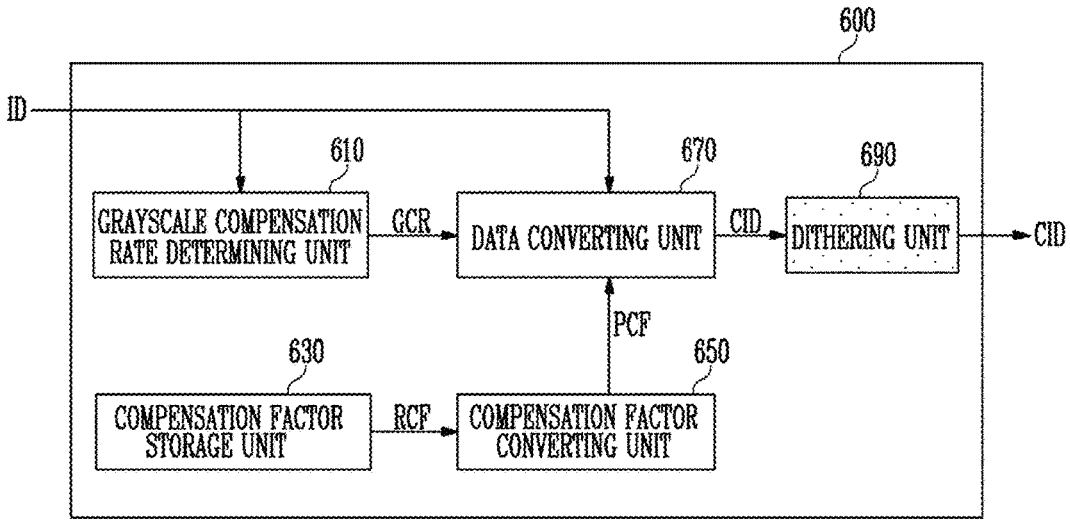
FIG. 6 is a block diagram illustrating an embodiment of an image data compensation unit of FIG. 5.

FIG. 6 is a block diagram illustrating an embodiment of an image data compensation unit of FIG. 5. An image data compensation unit 600 may include a gray scale compensation rate determining unit 610, a compensation factor storage unit (e.g., compensation factor storage, memory, or buffer) 630, a compensation factor converting unit (e.g., a compensation factor converter) 650, a data converting unit (e.g., data converter) 670, and a dithering unit (e.g., ditherer) 690. Hereinafter, a display device, and a method of compensating for color deflection thereof, according to embodiments of the present invention, will be described with reference to FIGS. 4 and 6.

Referring to FIGS. 4 and 6, region compensation factors RCF, which correspond to a plurality of partial regions (e.g., partial regions Bi), and which are stored in the compensation factor storage unit 630, are sent/loaded to the compensation factor converting unit 650 (S410). The region compensation factors RCF may include a red region compensation factor, a green region compensation factor, and a blue region compensation factor. In an embodiment, the compensation factor storage unit 630 may be an MTP register. As described above, in the case of the display device according to an embodiment of the present invention, because the number of region compensation factors RCF is significantly less than the number of pixels used for compensating for color deflection, a relatively low capacity storage device may be used as a compensation factor storage unit 630.

The compensation factor converting unit 650 may process the loaded region compensation factors RCF to calculate a pixel compensation factor PCF corresponding to each of the pixels (S430). Meanwhile, the data converting unit 670 receives image data ID (S450), and compensates for a gray scale of each pixel data included in the received image data ID on the basis of the pixel compensation factor PCF (S470). Converted image data CID is output as the compensation result on the display panel, and the display panel displays the converted image data CID generated on the basis of the compensated gray scale of the pixel data.

When the region compensation factor RCF is directly applied to the image data ID input to the pixels of a corresponding partial region Bi without converting the region compensation factor RCF, because the same region compensation factor RCF is applied to the pixels of the same partial region Bi, a difference between partial regions Bi of the display panel 530 may be visible. In the case of the display device according to an embodiment of the present invention, the region compensation factor RCF is interpolated according to resolution of the display panel 530 to generate a pixel compensation factor PCF, and image data ID is converted on the basis of the generated pixel compensation factor PCF to generate converted image data CID, and thus, color deflection of all of the pixels may be improved, while a boundary between the partial regions Bi is not visible.

The gray scale compensation rate determining unit 610 may determine a reflection rate of the pixel compensation factor PCF according to a gray scale of each of the pixel data included in the image data ID. For example, a pixel compensation factor regarding a pixel (for example, an mth pixel) at a certain position of the display device is transferred from the compensation factor converting unit 650, but a pixel compensation factor regarding the mth pixel may be applied at a different rate according to a gray scale of pixel data input to the mth pixel. For example, a 100% of pixel compensation factor PCF may be applied to a low gray scale, while only 50% of pixel compensation factor PCF may be applied to a high gray scale. In this manner, the pixel compensation factor PCF may be applied at different rates according to gray scales of pixel data. In case where pixel data included in image data ID includes gray scale data of 0 to 255, the gray scale compensation rate GCR may include values corresponding to the gray scales of 0 to 255. The gray scale compensation rate determining unit 610 may be a storage medium for storing a gray scale compensation rate (e.g., a predetermined gray scale compensation rate) GCR, and for transferring the stored gray scale compensation rate to the data converting unit 670, or may be a calculation device for calculating a gray scale compensation rate GCR (e.g., calculating the gray scale compensation rate GCR according to a predetermined regulation).

The dithering unit 690 may dither the converted image data CID output from the data converting unit 670, and may output the dithered image data.

Figure 7:
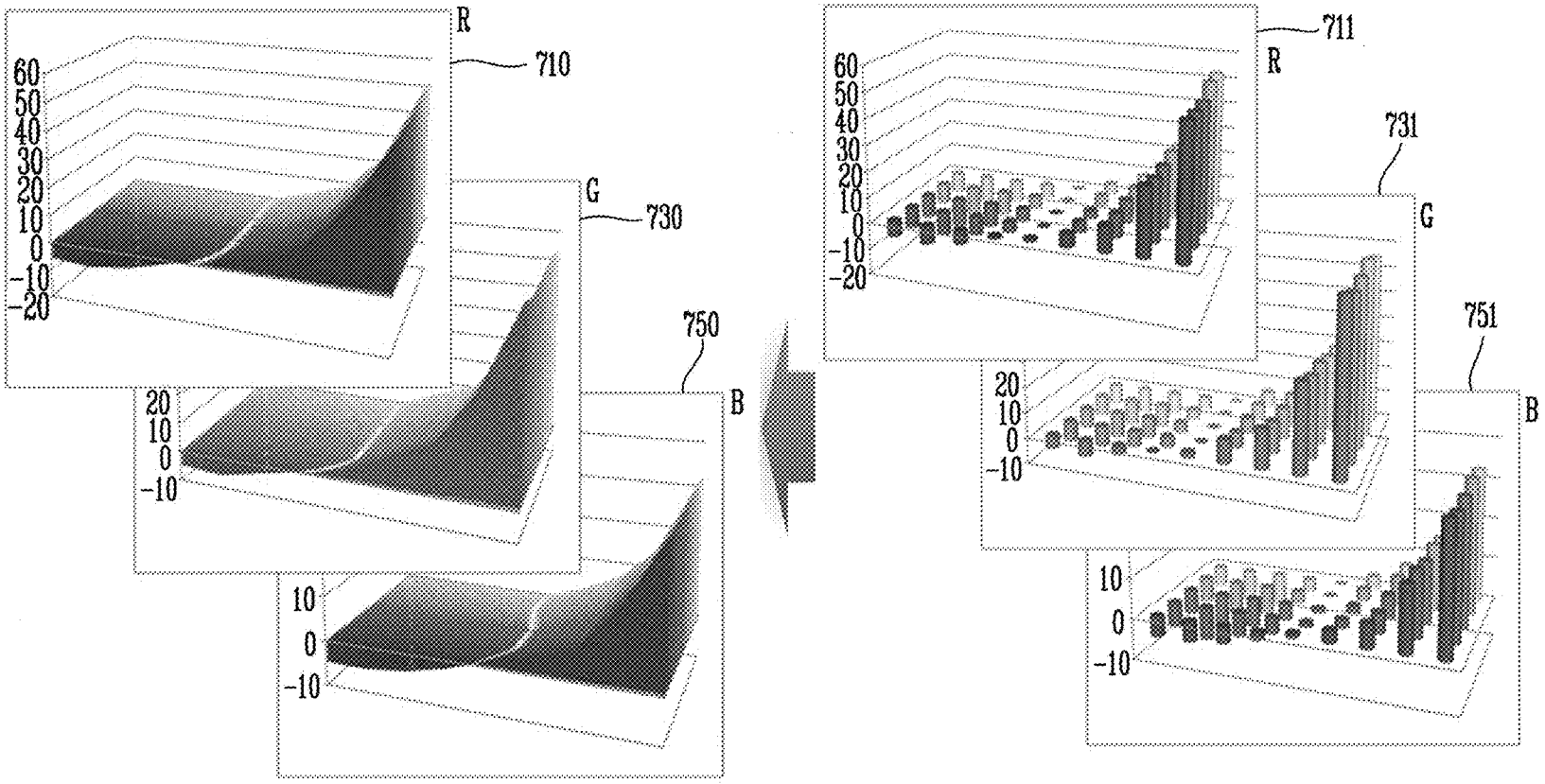
FIG. 7 is a view illustrating a process of calculating a pixel compensation factor by interpolating a region compensation factor according to an embodiment of the present invention.

FIG. 7 is a view illustrating a process of calculating a pixel compensation factor by interpolating a region compensation factor according to an embodiment of the present invention.

Referring to FIG. 7, graphs for expressing a red region compensation factor 711, a green region compensation factor 731, and a blue region compensation factor 751 is illustrated. Also, graphs for expressing a red pixel compensation factor 710, a green pixel compensation factor 730, and a blue pixel compensation factor 750 that are generated by interpolating the region compensation factors 711, 731, and 751 is also illustrated.

As illustrated in FIG. 7, the red pixel compensation factor 710 is generated by interpolating the red region compensation factor 711 on a 2D planar space. Also, the green pixel compensation factor 730 is generated by interpolating the green region compensation factor 731 on a 2D planar space. Further, the blue pixel compensation factor 750 is generated by interpolating the blue region compensation factor 751 on a 2D planar space.

As described above, the process of generating the pixel compensation factors by interpolating the region compensation factors may be performed by the compensation factor converting unit 650 of FIG. 6. Meanwhile, the aforementioned process may be performed in operation S430 of FIG. 4.

Figure 8:
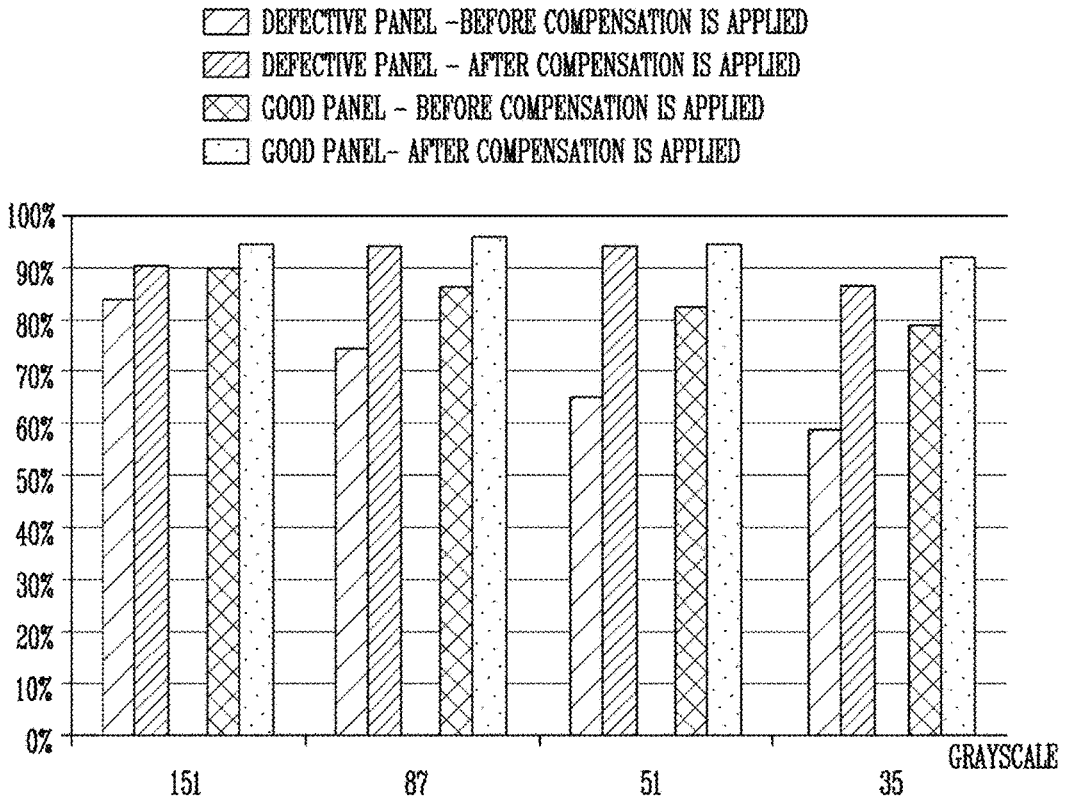
FIG. 8 is a graph illustrating an effect of a method of compensating for color deflection according to an embodiment of the present invention.

FIG. 8 is a graph illustrating an effect of a method of compensating for color deflection according to an embodiment of the present invention. The graph of FIG. 8 illustrates a change in a color gamut when the method of compensating for color deflection is applied to a defective panel and to a good, non-defective panel. In particular, a change in a color gamut regarding grayscales of 151, 87, 51, and 35 is shown. Referring to FIG. 8, it can be seen that a color gamut is increased whether the method of compensating for color deflection is applied to a defective panel or to a good panel.

Figure 9:
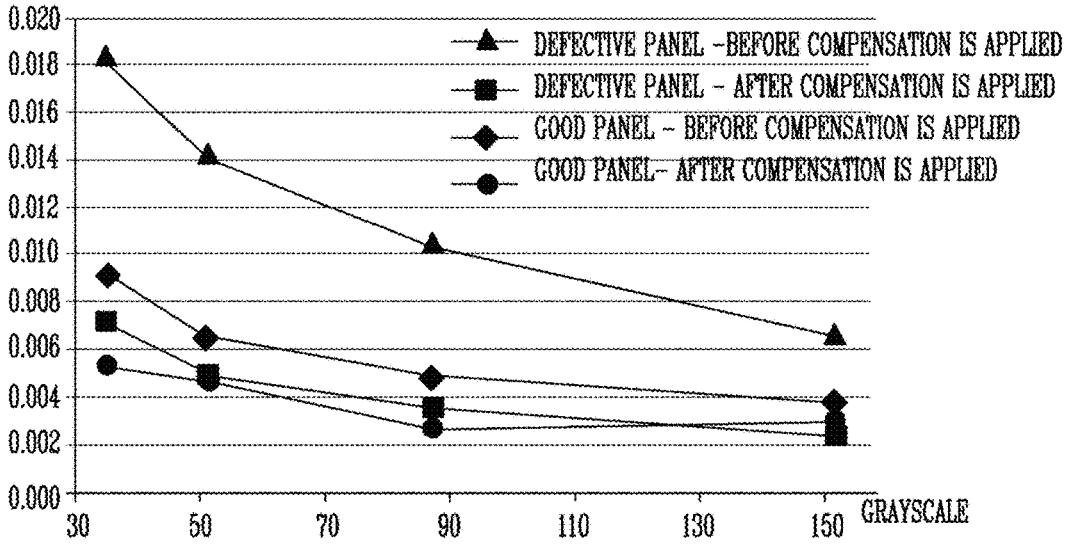
FIG. 9 is another graph illustrating an effect of a method of compensating for color deflection according to an embodiment of the present invention.

FIG. 9 is another graph illustrating an effect of a method of compensating for color deflection according to an embodiment of the present invention. The graph of FIG. 9 illustrates a change in color deflection when the method of compensating for color deflection is applied to a defective panel and to a good panel. In detail, in FIG. 9, color deflection expressed as $\Delta uv$ is illustrated. Referring to FIG. 9, it can be seen that, when color deflection is compensated according to the present embodiment, color deflection is reduced in the entire gray scale region both in a defective panel and in a good panel.

It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Furthermore, the respective block diagrams may illustrate parts of modules, segments or codes including at least one or more executable instructions for performing specific logic function(s). Moreover, it should be noted that the functions of the blocks may be performed in different order in several modifications. For example, two successive blocks may be performed substantially at the same time, or may be performed in reverse order according to their functions.

The term "unit or part" according to embodiments of the invention, means, but is not limited to, a software or hardware component, such as a Field Programmable Gate Array (FPGA) or Application Specific Integrated Circuit (ASIC), which performs certain tasks. A unit or part may advantageously be configured to reside on the addressable storage medium and configured to be executed on one or more processors. Thus, a unit or part may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units or parts may be combined into fewer components and units or parts or further separated into additional components and units or parts. In addition, the components and units or parts may be implemented such that they execute one or more CPUs in a device or a secure multimedia card.

Embodiments of the present invention described in detail hereinabove are proposed for the purpose of describing particular embodiments only, and are not intended to be limiting of the invention. In addition to the embodiments of the present invention illustrated and described herein, various other changes and modifications can be made without departing from the spirit and scope of the invention.

What is claimed is:

1. A method of compensating for color deflection of a display device, the method comprising:

dividing a display region of a display panel into a plurality of partial regions;

displaying a reference image in the display region;

measuring optical characteristics of the partial regions based on the reference image;

calculating a region compensation factor by the partial regions based on the optical characteristics; and storing the region compensation factor in a storage device of the display device, wherein the display device comprises:

the display panel; and an image data compensator to load the region compensation factor, to calculate a pixel compensation factor by interpolating the region compensation factor according to a resolution of the display panel, to calculate a compensation rate regarding each grayscale of pixel data, and to compensate for a grayscale of the pixel data based on the pixel compensation factor and the compensation rate regarding each grayscale.

2. The method of claim 1, wherein the displaying of the reference image comprises displaying a red image, a green image, or a blue image.

3. The method of claim 2, wherein the region compensation factor comprises:

a red region compensation factor for compensating a red color;

a green region compensation factor for compensating a green color; and a blue region compensation factor for compensating a blue color.

4. The method of claim 1, wherein the measuring of the optical characteristics comprises capturing the reference image using a camera.

5. The method of claim 4, wherein a resolution of the camera is lower than a resolution of the display panel.

6. The method of claim 1, wherein the measuring of the optical characteristics comprises capturing the reference image using a color sensor array.

7. The method of claim 1, wherein each of the partial regions comprises a plurality of pixels, and wherein the optical characteristics comprise an average brightness displayed in each of the partial regions.

8. The method of claim 7, wherein the calculating of the region compensation factor comprises calculating the region compensation factor corresponding to the partial regions based on the average brightness measured in the partial regions.

9. The method of claim 1, wherein the storing of the region compensation factor comprises storing the region compensation factor in a register within the display device.

10. A method of compensating for color deflection of a display device, the method comprising:

loading a region compensation factor corresponding to a plurality of partial regions of a display panel;

processing the loaded region compensation factor to calculate a pixel compensation factor corresponding to each pixel of the display panel by interpolating the region compensation factor according to a resolution of the display panel;

receiving image data comprising pixel data;

calculating a compensation rate regarding each grayscale of the pixel data; and compensating for the grayscale of each pixel data based on the pixel compensation factor and the compensation rate.

11. The method of claim 10, further comprising displaying the image data based on the compensated grayscale of each pixel data.

12. The method of claim 10, wherein the loading of the region compensation factor comprises loading the region compensation factor from an MTP register of the display device.

13. A display device comprising:

a display panel comprising a plurality of partial regions; and an image data compensator for compensating for a grayscale of a plurality of pixel data of input image data based on a region compensation factor corresponding to the partial regions, and for outputting the compensated image data to the display panel, wherein the image data compensator comprises:

a compensation factor storage device for storing the region compensation factor;

a compensation factor converter for loading the region compensation factor, and for interpolating the region compensation factor according to a resolution of the display panel to calculate a pixel compensation factor;

a grayscale compensation rate determiner configured to calculate a compensation rate regarding each grayscale of pixel data; and a data converter for compensating for a grayscale of the pixel data based on the pixel compensation factor and the compensation rate regarding each grayscale.

14. The display device of claim 13, wherein the compensation factor storage device comprises an MTP register.

* * * * *